United States Patent [19]

Rothfjell

[11] Patent Number: 4,464,448

[45] Date of Patent: Aug. 7, 1984

[54] METHOD OF PRODUCING AN IDENTITY DOCUMENT

[75] Inventor: Rolf E. Rothfjell, Kalix, Sweden

[73] Assignee: AB Rollfilm, Stockholm, Sweden

[21] Appl. No.: 510,641

[22] Filed: Jul. 5, 1983

Related U.S. Application Data

[63] Continuation-in-part of Ser. No. 304,664, Sep. 22, 1981, abandoned.

[30] Foreign Application Priority Data

Oct. 1, 1980 [SE] Sweden ..... 8006858

[51] Int. Cl.[3] ..... G03C 7/16; G03C 7/00; G09F 3/02

[52] U.S. Cl. ..... 430/22; 430/10; 430/17; 430/364; 430/394; 430/952; 40/625; 40/626; 283/77; 283/85; 283/93

[58] Field of Search ..... 430/10, 15, 17, 364, 430/383, 952, 22, 394, 140; 40/1.5, 625, 626, 630; 283/77, 93, 85

[56] References Cited

U.S. PATENT DOCUMENTS

| | | | |
|---|---|---|---|
| 3,610,120 | 10/1971 | Morse et al. | 430/10 |
| 3,655,494 | 4/1972 | Buzzell | 430/10 |
| 4,311,774 | 1/1982 | Raphael | 430/10 |

FOREIGN PATENT DOCUMENTS

| | | | |
|---|---|---|---|
| 747521 | 8/1970 | Belgium | 430/952 |
| WO80/01520 | 7/1980 | PCT Int'l Appl. | 430/10 |

*Primary Examiner*—Richard L. Schilling
*Attorney, Agent, or Firm*—Silverman, Cass & Singer, Ltd.

[57] ABSTRACT

A black and white microfilm reproduction is made of a person or their photograph and accompanying text data. A sheet of multicolor photographic paper then is exposed to the black and white image carried on the microfilm and to another color film carrying a multicolor security pattern, mark or the like. The paper then is developed to produce the document having a black and white image of the person to be identified and accompanying text data together with overlying multicolor security pattern. The security pattern has lines that vary in color along their lengths independently of one another.

5 Claims, No Drawings

METHOD OF PRODUCING AN IDENTITY DOCUMENT

This application is a continuation-in-part of copending application Ser. No. 304,664 filed Sep. 22, 1981, now abandoned.

This invention relates generally to the production of an identity document, such as a driver's license or identity card, that includes a photograph of the person to be described or identified by the document, and in particular, relates to an identity document in which an identifying black and white photograph and a color security pattern are formed in the identity document.

It is known to produce a driver's license or other similar document starting with a photograph and text data concerning the person. The photograph and data are photographically reproduced in a reproduction film that is used to form a print of the photograph and data on a sheet of black and white photograph paper. The print then is mechanically overprinted in color with a security pattern, mark or the like by means of a mechanical letterpress printing block. Lastly, the resulting product is provided with a plastic coating on one or both sides.

The known process thus requires a photographic reproduction in the form of a print and a mechanical over printing process, which is an expensive method of production.

The present invention produces such documents less expensively by carrying out the entire operation photographically, eliminating the mechanical printing process. The invention uses a multicolor photographic paper, instead of a black and white photographic paper, so that the security pattern, mark or the link in color can be applied by photographic reproduction instead of by mechanical printing.

It is difficult for the human eye clearly to see the photograph of the face of a person in a security document if the image of the person and the security pattern are in color and the security pattern covers the image of the person. But a multicolor security pattern is desirable to achieve a high security level and further it is desirable to have at least a portion of the image covered by the security pattern also to achieve a high security level. Unfortunately, this results in an image that is difficult to discern if the image is in color. The solution to this problem is the reproduction of the person's facial image in black and white and the reproduction of the security pattern in several colors in the same color film. The person's facial image thus can clearly be seen, which is an important factor.

According to the invention, a black and white or color photograph of the person to be identified and relevant text data are assembled together on a data sheet carrying any desired preprinted logo or mark. The data sheet then is exposed to a sheet of black and white microfilm and is reproduced therein. Alternatively, the microfilm can be exposed to the data sheet while the microfilm camera simultaneously takes a microfilm picture of the subject person.

A sheet of multicolor photographic paper then is exposed to the image carried on the black and white microfilm and is exposed to an additional color film carrying a multicolor security pattern, mark or the like. This additional color film is not a microfilm of the security pattern, but is a one-to-one scale image of the security pattern to be photographically reproduced in the print. This provides for a quality reproduction of complicated and fine lines in the pattern without distortion.

The sheet of multicolor photographic paper then is developed to reproduce the picture and text in black and white and the security pattern, mark or the like in several colors. Thus, the photograph of the person to be identifid can be either a black and white or color photographic negative or positive, and the security pattern can have any desired complicated form or coloring.

The invention thus provides for the inclusion of the security pattern in the photographic emulsion carrying the photograph and text data of the person identified. The security pattern, edgings or the like can be formed over the whole or a portion of the surface covered by the photograph of the person. Further, security patterns with optional colors and forms readily are formed in the document.

The invention provides for the possibility of the security pattern lines being hand drawn and further for the color of the lines to vary gradually along their lengths. Each line also may vary in color independent of any other line. This is difficult or impossible to provide using conventional printing techniques. Convention printing methods produce color transitions only along straight lines or in bands because the printing operation is performed along a straight-line paper path, and the different color inks are provided next to one another.

Known filters are available, when desired, that are placed between the black and white microfilm and the color print paper to avoid the black and white image being formed in the color print paper having a touch of violet, dark brown or other undesirable color therein. These filters provide a clean black and white image on the color print film.

The invention thus discloses a method by which highly sophisticated documents, which are extremely difficult to reproduce, are produced. The resulting document can be worked further in a usual manner to provide a plastic coating or laminate so that a completed identity card is obtained.

I claim:

1. A method of producing an identity document comprising:

A. exposing a multicolor photographic paper surface to an image of a black and white object to be reproduced thereon;

B. exposing said multicolor photographic paper surface to a security pattern, the pattern being superimposed over at least a portion of the surface on which said image is to be reproduced and said pattern consisting of several colors; and C. developing said multicolor photographic paper so that a composite photograph of said image and security pattern is obtained with the pattern being superimposed in several colors over at least a portion of said black and white image.

2. The method of claim 1 including forming said image by simultaneously exposing a sheet of black and white microfilm to a picture of the person to be identified and accompanying text data.

3. The medthod of claim 1 including forming said image by simultaneously exposing a sheet of black and white microfilm to the face of the person to be identified and accompanying text data.

4. The method of claim 1 in which exposing said security pattern includes providing a security pattern comprising lines that vary in color over their length and vary in color from line to line independently of one another.

5. The method of claim 1 in which exposing said security pattern includes providing a security pattern on a one-to-one scale with the identity document to be produced.

* * * * *